US007302952B2

(12) United States Patent
Haul

(10) Patent No.: US 7,302,952 B2
(45) Date of Patent: Dec. 4, 2007

(54) DEVICE AND PROCESS FOR CONVEYING ROD-SHAPED FILTER ELEMENTS

(75) Inventor: Michael Haul, Kröppelshagen (DE)

(73) Assignee: Hauni Maschinenbau AG, Hamburg (DE)

( * ) Notice: Subject to any disclaimer, the term of this patent is extended or adjusted under 35 U.S.C. 154(b) by 482 days.

(21) Appl. No.: 10/658,200

(22) Filed: Sep. 10, 2003

(65) Prior Publication Data

US 2004/0099610 A1 May 27, 2004

(30) Foreign Application Priority Data

Sep. 11, 2002 (EP) ..... 02020292

(51) Int. Cl.
*A24B 31/00* (2006.01)
*B65G 51/36* (2006.01)

(52) U.S. Cl. ..... 131/29; 131/88; 406/10; 406/34; 493/39

(58) Field of Classification Search ..... 210/91; 55/356; 96/423; 131/88, 94, 29; 198/340, 198/341.01, 341.02, 341.03, 343.1, 345.1, 198/572; 406/52, 62, 68, 70, 72, 83, 10, 406/28, 34; 493/39–50
See application file for complete search history.

(56) References Cited

U.S. PATENT DOCUMENTS 2,649,761 A * 8/1953 Edwards ..... 131/94
3,062,588 A * 11/1962 Molins et al. ..... 406/32
3,365,239 A * 1/1968 Molins et al. ..... 406/62
3,805,477 A * 4/1974 Kruse et al. ..... 53/456
3,827,757 A * 8/1974 Heitmann et al. ..... 406/67
4,245,934 A * 1/1981 Hinchcliffe et al. ..... 406/62
4,368,742 A 1/1983 Wahle et al.
4,372,710 A 2/1983 Kasparek et al.
4,618,293 A * 10/1986 Heitmann ..... 406/28
5,641,250 A * 6/1997 Bostelmann et al. ..... 406/11
5,651,643 A 7/1997 Haul et al.
6,371,125 B1 4/2002 Schmidt
6,415,474 B1 7/2002 Schmidt
2002/0088479 A1 7/2002 Schmidt

FOREIGN PATENT DOCUMENTS

DE 10155292 5/2003
JP 54-13195 1/1990

* cited by examiner

*Primary Examiner*—Joseph Drodge
(74) *Attorney, Agent, or Firm*—Greenblum & Bernstein, P.L.C.

(57) ABSTRACT

Device and process for conveying filter elements to a filter element magazine. The device includes a rotatable drum comprising at least one seat for receiving a filter element and a detection device that controls a rotation of the drum and detects the filter elements. The process includes conveying at least one filter element in a lengthwise axial direction to a drum that includes seats, wherein at least one of the seats is adapted to receive the at least one filter element, guiding the at least one filter element past a detection device, generating a start signal as soon as an end of the at least one filter element has passed the detection device, rotating the drum in a crosswise axial direction after receiving the start signal, and moving the at least one filter element into the filter element magazine.

29 Claims, 8 Drawing Sheets

DEVICE AND PROCESS FOR CONVEYING ROD-SHAPED FILTER ELEMENTS

CROSS-REFERENCE TO RELATED APPLICATIONS

The present application claims priority under 35 U.S.C. §119 of European Patent Application No. 02 020 292.5, filed on Sep. 11, 2002, the disclosure of which is expressly incorporated by reference herein in its entirety.

BACKGROUND OF THE INVENTION

1. Field of the Invention

The invention relates to a device for conveying rod-shaped filter elements to a filter element magazine, whereby filter elements that can be fed in a lengthwise axial manner can be fed to the filter element magazine in a crosswise axial manner, and whereby a drum that can be rotated in a crosswise axial manner is provided with at least one seat for a filter element.

The invention further relates to a process for controlling the conveyance of filter elements to a filter element magazine.

2. Discussion of Background Information

A corresponding device for conveying rod-shaped filter elements is known, e.g., from JP 54-13195. This document discloses a filter receiver with an impeller wheel in which filter rods arriving in a lengthwise axial manner are braked with suction air. The impeller wheel is hereby driven intermittently and delivers the filter rods to a belt conveyor.

Another known device for conveying rod-shaped filter elements to a filter element magazine or a corresponding process for conveying filter elements to a filter element magazine is known from the assignee's so-called filter rod loading system FILTROMAT 3 FE. Such a filter rod loading system or such a filter rod receiver receives filter rods in a lengthwise axial manner, which filter rods are first braked in order then to be accelerated in a lengthwise axial manner. Subsequently filter rods are fed to the filter magazine in a crosswise axial manner. Various module variants are known in this connection. For example, there are individual receivers, double receivers and triple receivers. In this connection, it is possible to regulate the speed of the filter rod receiver depending on the demand for filter rods.

In the production of multi-segment filters with a device made up of modules, as is known, e.g., from DE 101 55 292.0 of the assignee, the use of the FILTROMAT 3 FE is problematic because of the construction size.

SUMMARY OF THE INVENTION

The present invention provides for a device for conveying rod-shaped filter elements to a filter element magazine, and a corresponding process for controlling the conveyance of the filter elements to a filter element magazine. An effective conveyance of the rod-shaped filter elements is thus possible within a very small space.

The invention also provides for a device for conveying rod-shaped filter elements, in particular filter rods, to a filter element magazine. The filter elements can be conveyed in a lengthwise axial manner and can be fed to the filter element magazine in a crosswise axial manner. A rotatable drum is provided with at least one seat for a filter element. The device further provides that the rotation of the drum can be controlled via a detection device that detects the filter elements. The device according to the invention can be realized in a very compact construction, whereby the filter elements can be fed to the filter element magazine very effectively, as well as very quickly, and in a controlled manner. By providing a detection device, the clocking of the rotation of the drum can be set very high, comparatively speaking.

A device that can be realized particularly easily is given when the detection device comprises a light barrier. The beginning and the end of filter elements conveyed through the detection device or past the detection device can be detected by way of the light barrier, as a result of which the rotatable drum can be controlled accordingly. The detection device is preferably arranged spaced at a distance from the drum so that the rotation of the drum can already be started at a point in time when the filter element has not yet been fully conveyed into the respective seat of the drum. As a result, a faster conveyance is possible.

When the drum interacts with a mechanical element that causes a crosswise axial insertion of the filter elements into the filter element magazine, a very gentle conveyance of the filter elements into the filter element magazine is possible. As the mechanical element, e.g., a fork or a cam, is suitable for engaging in the seats of the drum and this represents a firm obstacle for the disposition of the filter elements in the respective seats during further rotation of the drum.

A particularly defined conveyance that is failsafe is given when the conveyance of the filter elements to the drum takes place via elements arranged in a fixed manner. The elements arranged in a fixed manner can include pipes or pipelines through which the filter elements are conveyed in a lengthwise axial manner, brake wheels for braking the filter elements, accelerating wheels for accelerating the filter elements in the lengthwise axial direction and an, e.g., straight conveyor belt downstream of the brake wheels.

If several seats are provided in the drum, whereby the seats in particular are grooves, a very fast conveyance of filter elements is possible.

Preferably a braking element for braking the filter element that can be moved into the seat of the drum is provided. This makes it possible to provide for a gentle conveyance of the filter elements into the seats of the drum. The braking element can be a mechanical element, such as a brake plate that presses radially on the rod-shaped filter elements or an override part that presses on the face on the circumference of the filter element. It can also be a pneumatic element that admits, e.g., compressed air pneumatically clocked into the seats provided to accept the filter elements in order to correspondingly brake the filter elements. Expediently the braking of the filter elements moved in a lengthwise axial manner can occur pneumatically on the face side, whereby, e.g., a nozzle is arranged on the face side of a seat, and whereby compressed air from the nozzle acts on the front end of the filter element in the movement direction. This braking is particularly suitable for delicate filter elements.

Switching on of the compressed air can occur, preferably, with a high-speed valve, e.g., the FESTO brand or type. The valve can be controlled or clocked via a light barrier at the drum inlet.

The drum can preferably be rotated before the filter element has reached its final position in the seat of the drum. To this end, the control is preferably realized in the form that the rotation of the drum starts before the complete inward movement of the filter element. By way of this preferred embodiment of the present invention, a particularly gentle braking of the filter elements is possible. The drum preferably includes at least one element for aligning the filter elements. Through this measure the filter elements can be fed to the filter magazine in a flush manner.

If an ejection mechanism for defective filter elements is provided, the waste of, e.g., defective filter cigarettes for which the corresponding filter elements are provided, can be minimized. A kind of self-cleaning of the filter element receiver station is preferably provided. To this end, e.g., a cutting element rotating with the drum, e.g., a rotating cutting ring, is provided which cuts a filter rod partially entered into the drum as the drum rotates by one position. As mentioned, the cutting element comprises the cutting ring rotating with the drum and a fixed cutting element. The rear part of the filter rod remaining in the longitudinal transport is then blown back, e.g., by way of an air blast and ejected by opening a corresponding flap provided for this purpose. To this end a rail can also be opened that is provided in the lower area of an element used for longitudinal transport. This element is arranged in the conveyor direction just in front of the drum. The front part of the filter element is transported, e.g., two positions of the drum further and then blown out of the drum.

After the self-cleaning, the corresponding drum groove or the corresponding drum seat is monitored, e.g., by way of a light barrier, in order to establish whether parts of the filter element are still contained in the seat.

A filter element receiver station according to the invention may include a device according to the invention or a preferred embodiment of the device according to the invention that was described above.

A preferred arrangement for conveying filter elements to a filter element magazine with at least one of the devices according to the invention is such that the device is arranged outside the filter element magazine. Through this preferred arrangement, defective filter elements can be excluded from the further process very effectively. With arrangements for producing multi-segment filters it is further possible that the corresponding modules by way of which corresponding segments or groups of segments are assembled to produce the multi-segment filters, can be embodied such that the corresponding modules can be constructed to be very narrow. Preferably several devices, in particular three devices, are arranged according to the invention. In a further preferred embodiment of the arrangement according to the invention, the devices are arranged one below the other, which renders possible an even narrower construction of the arrangement.

The invention also provides for a process for controlling the conveyance of rod-shaped filter elements to a filter element magazine that features the following process: conveying filter elements in the lengthwise axial direction to a drum with at least one seat for a filter element, in particular to a device; guiding the filter elements past a detection device; generating a start signal as soon as the end of a filter element has passed the detection device; starting a rotation of the drum in the crosswise axial direction after receiving the start signal; and inserting the filter element into the filter element magazine.

Through this process a very effective, reliable and fast conveyance of rod-shaped filter elements to a filter element magazine is possible.

Preferably the drum is rotated by 360° divided by the number of seats on the drum. If a braking occurs at the end of the rotation, a gentle conveyance of the filter elements or a gentle insertion of the filter elements into the filter element magazine is possible. The braking can hereby preferably occur at least partially with the aid of the weight of the filter elements arranged in the filter element magazine.

When the quality of the filter elements is tested, whereby defective filter elements are discharged, the waste of filter cigarettes to be produced accordingly is minimized. A particularly simple test of the quality is possible if the length of the dwell time of the filter elements at the detection device is measured to test the quality of the filter elements. Preferably after a dwell time that is dependent on the conveyor speed and that can be predetermined, the filter element assigned to this dwell time is discharged. The discharge thus occurs when the dwell time of the filter element is greater than a dwell time that is dependent on the conveyor speed and that can be predetermined. On the other hand, preferably up to a dwell time that is dependent on the conveyor speed and that can be predetermined, the filter element assigned to this dwell time is conveyed into the filter element magazine.

The invention also provides for a device for conveying filter elements to a filter element magazine, wherein the device comprises a rotatable drum comprising at least one seat for receiving a filter element and a detection device that controls a rotation of the drum and detects the filter elements.

The filter elements may comprise filter rods. The filter elements may comprise rod-shaped filter elements. The device may further comprise a mechanism that feeds the filter elements in a lengthwise axial manner to the drum. The filter elements may be fed to the filter element magazine in a crosswise axial manner. The detection device may comprise a light barrier. The drum may interact with a mechanical element that causes a crosswise axial insertion of the filter elements into the filter element magazine. The device may further comprise a mechanism that causes a crosswise axial insertion of the filter elements into the filter element magazine. The device may further comprise at least one fixed element that conveys the filter elements to the drum. The at least one seat may comprise a plurality of seats. The device may further comprise a braking element which engages the filter element. The braking element may act to provide braking to the filter element once the filter element is moved into the at least one seat. The braking element acts to provide braking to the filter element as the filter element is moved into the at least one seat. The device may further comprise a retaining mechanism which traps the filter element after the filter element is moved into the at least one seat. The retaining mechanism may be movably mounted. The retaining mechanism can move away from the drum when the drum is rotated. The drum may be adapted to rotate before the filter element has reached a final position in the at least one seat. The drum may include an element for aligning the filter elements. The device may further comprise a mechanism for aligning the filter elements on the drum. The device may further comprise an ejection mechanism adapted to eject defective filter elements.

The invention also provides for a filter element receiver station comprising the device described above.

The invention also provides for an arrangement for conveying filter elements to a filter element magazine, wherein the arrangement comprises at least one device as described above and the filter element magazine, wherein the at least one device is arranged outside the filter element magazine.

The at least one device may comprise a plurality of devices. The plurality of devices may comprise three devices. The plurality of devices can be arranged one below the other relative to a horizontal axis running through at least one of the plurality of devices.

The invention also provides for a process for controlling movement of filter elements to a filter element magazine, wherein the process comprises conveying at least one filter element in a lengthwise axial direction to a drum that includes seats, wherein at least one of the seats is adapted to receive the at least one filter element, guiding the at least one filter element past a detection device, generating a start signal as soon as an end of the at least one filter element has passed the detection device, rotating the drum in a crosswise axial direction after receiving the start signal, and moving the at least one filter element into the filter element magazine.

The rotating may comprise rotating the drum to an angle that is approximately equal 360° divided by a number of the seats. The process may further comprise determining whether the at least one filter element is defective or not. The process may further comprise discharging the at least one filter when it is determined to be defective. The determining may comprise measuring a dwell time. The measuring may comprise measuring a length of the dwell time at the detection device. The measuring may comprise measuring a length of the dwell time using the detection device. The process may further comprise discharging the at least one filter element when the dwell time is greater than a predetermined amount. The predetermined amount may be dependent on a speed of the conveying. The conveying may comprise feeding the at least one filter element to the drum using a feeding mechanism that includes accelerating rollers, a channel and brake rollers. The least one filter element may be moved into the filter element magazine within a time period that is less than or equal to the dwell time.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
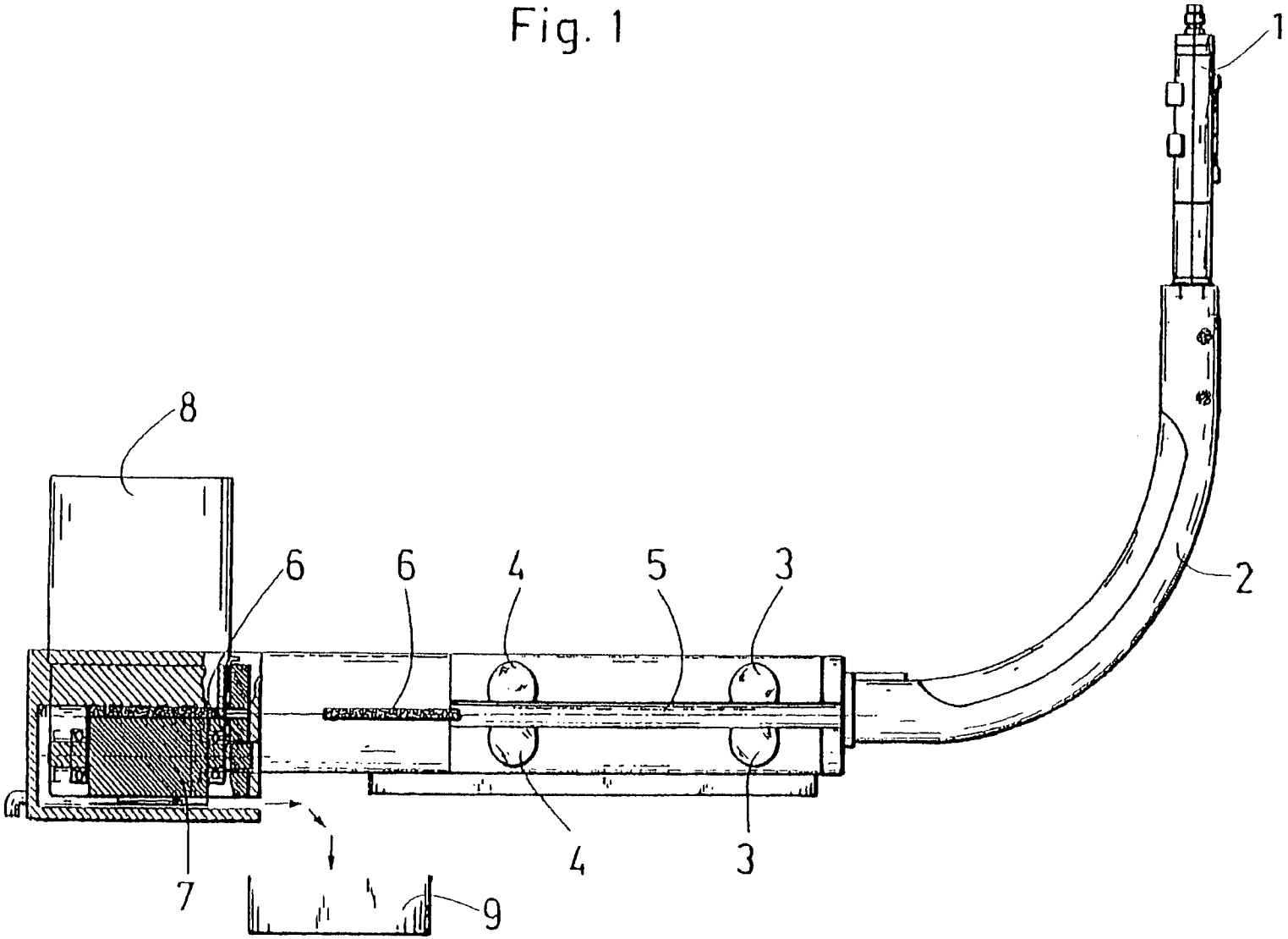
FIG. 1 shows a diagrammatic side view of a receiver station according to the invention.

FIG. 1 shows a filter element receiver for conveying rod-shaped filter elements 6 into a filter element magazine 8. After they have been cut, e.g., into filter elements of double unit length, the filter elements 6 fed into the filter element magazine 8 serve to be joined to a cut tobacco rod of double unit length in order to produce filter cigarettes. The filter elements 6 fed into the filter element magazine 8 can also serve to be cut into corresponding filter segments and fed to an arrangement of filter segments to produce multi-segment filters. To this end, the device according to the invention can be assigned to several or all functional units of a device for assembling groups of filter segments for producing multi-segment filters of the tobacco processing industry according to commonly assigned DE 101 55 292.0. Accordingly, the disclosure of DE 101 55 292.0 is hereby expressly incorporated by reference in its entirety.

Figure 2:
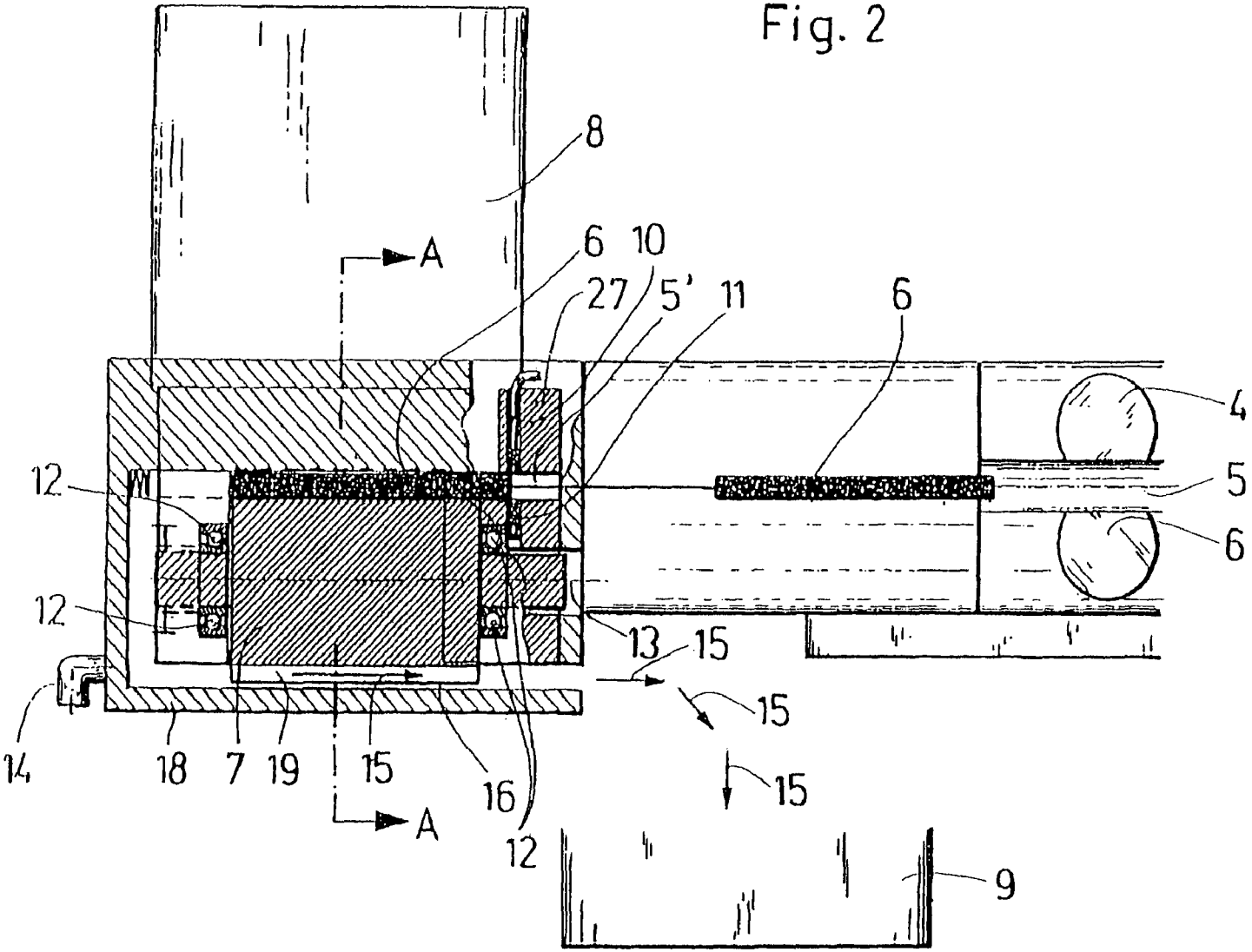
FIG. 2 shows a partial enlarged view of FIG. 1.

The filter elements of n-fold unit length are conveyed to a connecting line 1 via a pipeline from a filter production machine by way of a filter element emitter. The pipeline is not shown in FIG. 1. The filter elements 6 are conveyed, in a manner in which they are separated by spaces in the feed pipe, to the connecting line 1. They then reach a side guide bearing 2 and are braked by way of brake rollers 3 in a channel 5. The drum 7 is rotated by a motor (not shown). The motor can be, e.g., type DT4-4-10-R00-1500 by company AMK. Subsequently, the filter elements 6 are conveyed into a drum 7 by way of an accelerating roller 4 via a guide (not shown). The drum 7 and the other elements that are utilized in the invention are better shown in FIG. 2, which is an enlarged diagrammatic representation of a section from FIG. 1. In FIG. 2, the drum 7 is shown with a filter element 6 arranged in one of the seat grooves 19. In this process stage, the filter element 6 has already passed a light barrier which is made up of and/or includes a light-emitting diode 10 and a detector 11. The light barrier controls or detects the dwell time of the filter element and can be, e.g., a WLL170T light barrier by the company Sick. The drum 7 is supported and/or mounted on bearings 12 and is allowed to rotate about a rotational axis 13. The device functions in the following manner: if the filter element 6 is found or determined to be a defective filter element, it can be blown out with compressed air in the blowout direction 15 from the blowout channel 16. The blowout channel 15 is formed by the housing 18 and the seat groove 19. In this way, the defective filter element can be fed to a collecting container 9. As can be seen in FIG. 2, a compressed air connection 14 is provided to feed compressed air into the housing 18.

If the filter element 6 is found or determined not to be damaged or defective, the filter element 6 that is arranged in the seat 19 is further conveyed, i.e., via the rotational movement of the drum 7, and is fed to the magazine 8. This is described in more detail below. A mounting arrangement 27 is provided for holding the light-emitting diode 10 and the detector 11. The light-emitting diode 10 and the detector 11 form a light barrier mechanism.

Thus, the filter elements are transported in the axial direction and through the light barrier. The light barrier is located nearby the opening of the drum 7. When the light barrier detects the filter element, the driver (i.e., motor), which can accelerate the drum 7, starts to prepare for the movement of the drum 7. As soon as the light barrier is free again, the drum 7 is rotated to the next seat groove, i.e., it rotates a distance to the next seat groove. With regard to FIG. 2, the next seat is positioned behind the drum opening holding the filter element 6. If, on the other hand, the filter element 6 stays too long in the light barrier (e.g., approximately 20 ms or more), an automatic self-cleaning operation is started. This self-cleaning may include, e.g., blowing out or throwing out the filter element 6 from the groove 19, and/or cutting off or removing a portion of the filter element, and/or blowing out or throwing out the rest of the filter element 6.

Figure 3:
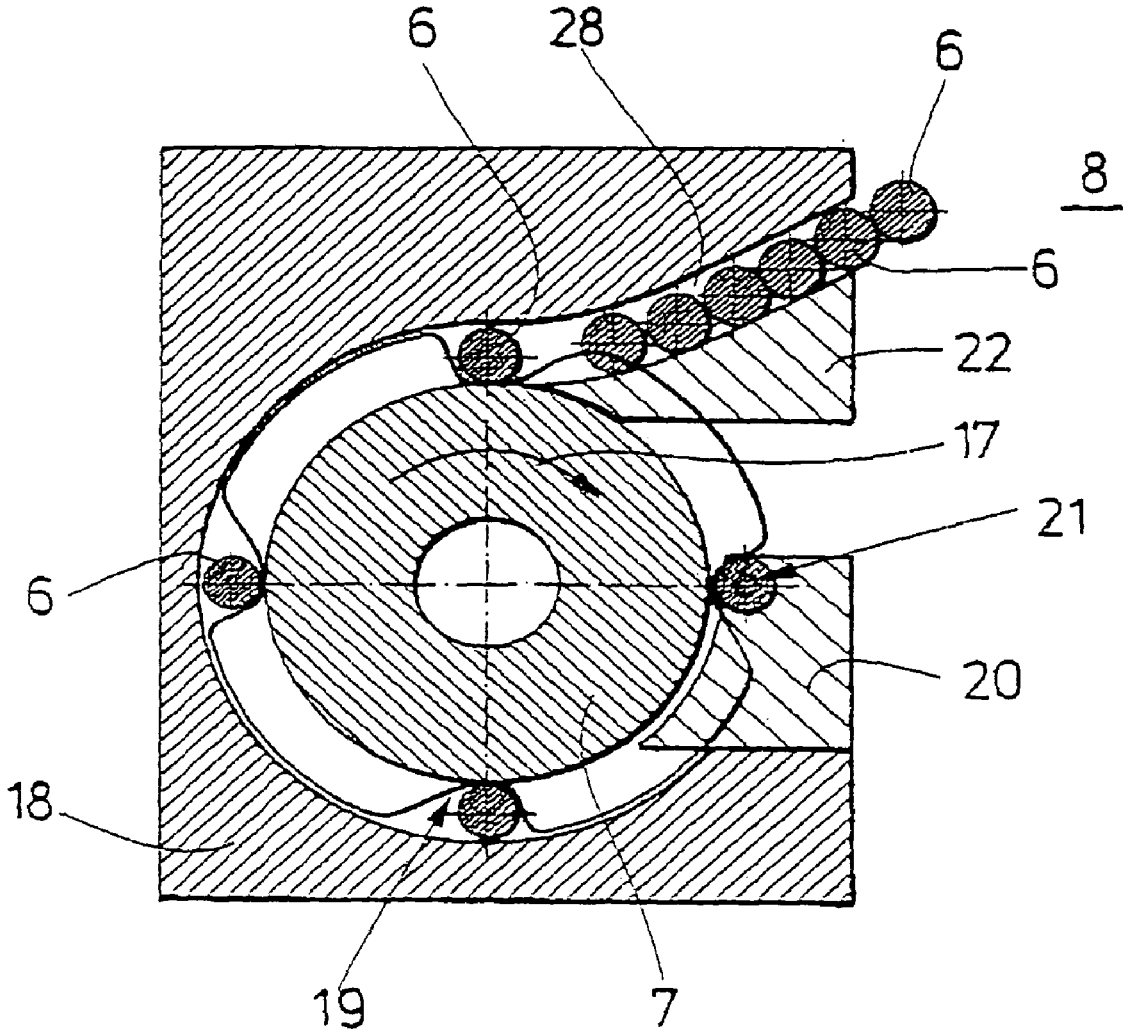
FIG. 3 shows a diagrammatic sectional view along the A-A section of FIG. 2.

FIG. 3 shows a diagrammatic sectional view along the section A-A of FIG. 2. In the embodiment shown in FIG. 3, the filter element 6 is arranged in a filter element feed position 21, i.e., at a three o'clock position. The filter element 6 is inserted in a lengthwise axial manner into the seat groove located there. After passing the light barrier, which comprises the light-emitting diode 10 and the detector 11, the drum 7 begins to rotate in the rotation direction 17. However, before the rotation occurs, the braking element 20, which brakes the filter element 6 in the seat groove 19, releases. The braking element 20 provides braking essentially through force exerted on the face-side circumferential surface of the filter element 6. As can be seen in FIG. 3, the face side is turned towards the viewer. By measuring the dwell time of the filter element 6 in the light barrier, the device can establish or determine whether the filter is defective (e.g., burst) or whether it corresponds (e.g., dimensionally or structurally) to the desired parameters. If the filter is found to be defective, it can then be ejected in the six o'clock position, e.g., by using an air blast. Alternatively, the invention contemplates that the defective filter can be ejected at the three o'clock position. To this end, the drum 7 will stand still (i.e., it will not be rotated), the filter element 6 can be blown back. The guide (not shown) can then swing out of the way and the filter element 6 can fall out. As the process continues, the drum 7 is rotated until the filter element 6 is aligned by a conventional aligning element, such as, e.g., a plate. From the twelve o'clock position, the filter element 6 can then be gently transferred into a channel 28 that is formed by the housing 18 and a cam 22. Through the corresponding gentle incline of a surface of the cam 22, in conjunction with a flat side surface of the seat groove 19 in the conveyor direction, it is possible to gently transfer the filter element 6 to the channel 28. As is evident from FIG. 3, the cam 22 engages partially in the seat grooves of the drum 7.

Figure 4:
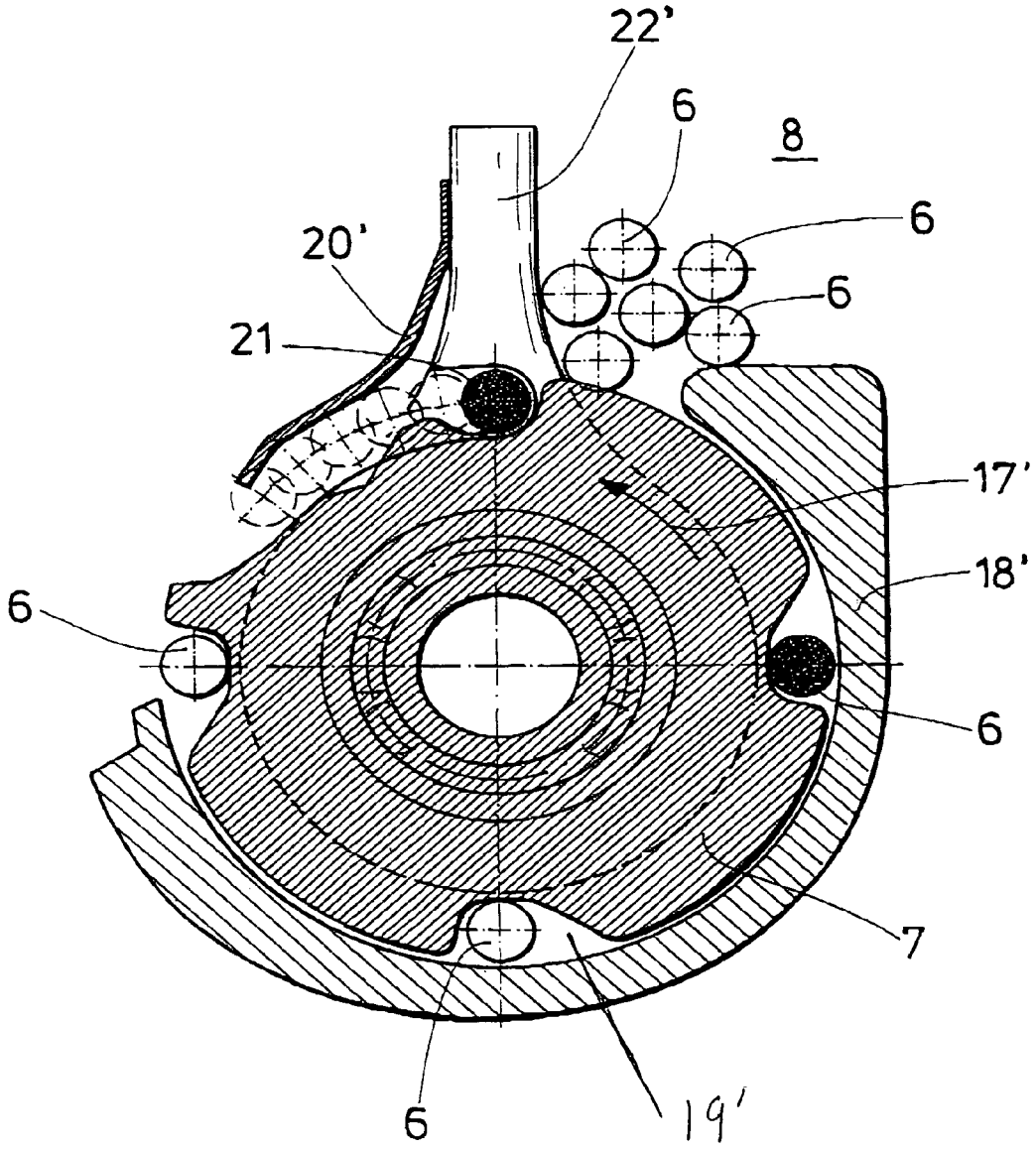
FIG. 4 shows another embodiment according to the invention of a drum in a sectional view.

FIG. 4 shows another embodiment of the drum 7 or the device according to the invention. FIG. 4 shows a corresponding section, in diagrammatic view, of a device which is similar to that shown in FIG. 3. FIG. 4, however, is different from FIG. 3 in many respects. The difference from FIG. 3 includes, for one thing, a filter element feed 21 that is arranged in the twelve o'clock position. Moreover, the rotational direction 17' is opposite to the rotational direction 17 shown in FIG. 3. In this arrangement, the filter element inserted in the seat groove 19 when the filter element feed 21 is braked by way of a braking element 20'. The braking element 20' can be in the form of a brake plate. In this embodiment, the light barrier, comprising the light-emitting diode 10 and the detector 11, is preferably arranged so as to be spaced in a lengthwise axial manner to the conveyor direction of the filter elements. In this way, the rotational movement of the drum 7 can begin before the filter element 6 has been moved completely into the seat groove 19 of the drum 7. A complete braking is thus provided after startup or after the start of the rotation of the drum 7 using the braking element 20'.

In FIG. 4, the cam 22' is also embodied differently from the cam 22 of FIG. 3. In this exemplary embodiment a gentle transfer is provided through the relatively gentle sides of both the cam 22' and the seat grooves 19'.

Figure 5:
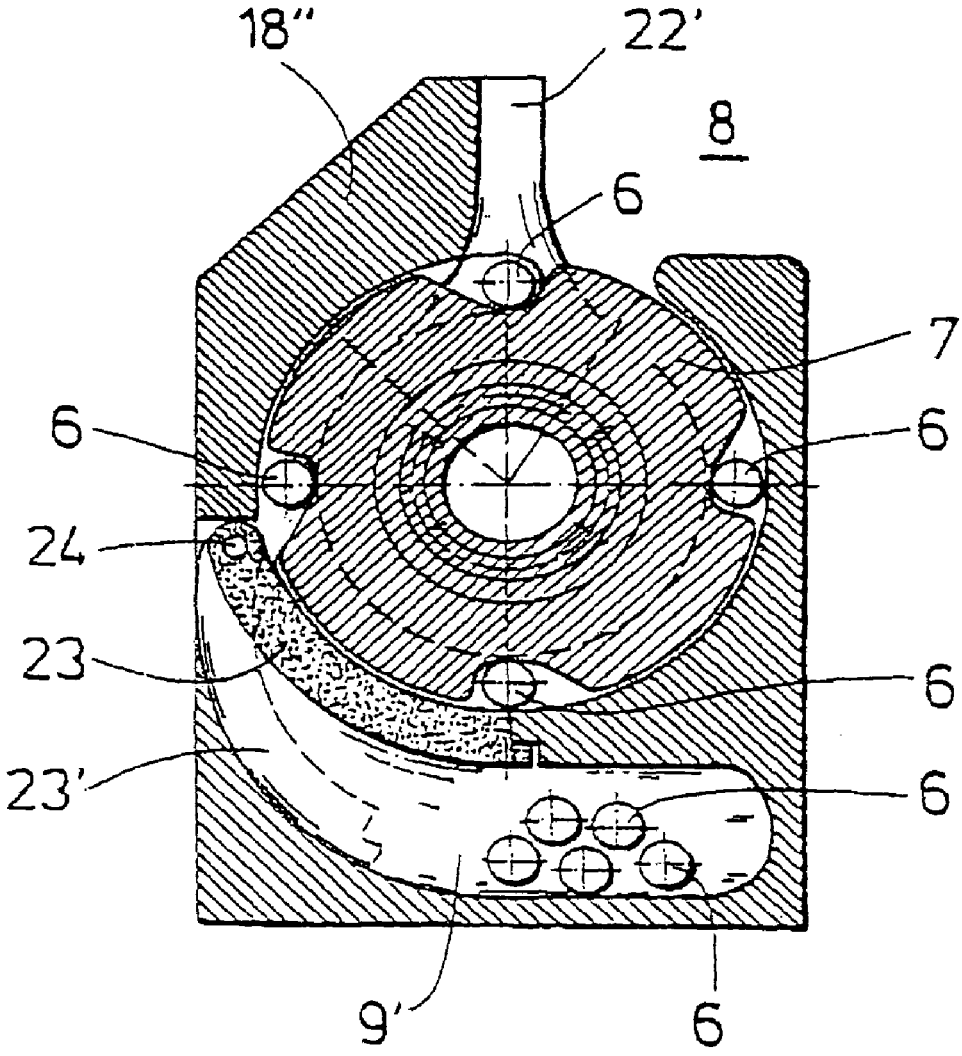
FIG. 5 shows another embodiment according to the invention of a drum in a diagrammatic sectional view.

FIG. 5 shows another embodiment of the device according to the invention. This embodiment is somewhat similar to that of FIG. 4 and is also shown in diagrammatic sectional view. However, in this exemplary embodiment, the ejection of defective filter elements 6 is accomplished with a flap 23 that opens on detection of a defective filter element 6, i.e., the flap 23 moves to a release position 23' through rotation or pivoting about a rotational or pivot axis 24. In this way, the filter element 6 that is defective is transferred to a collecting container 9.

Figure 6:
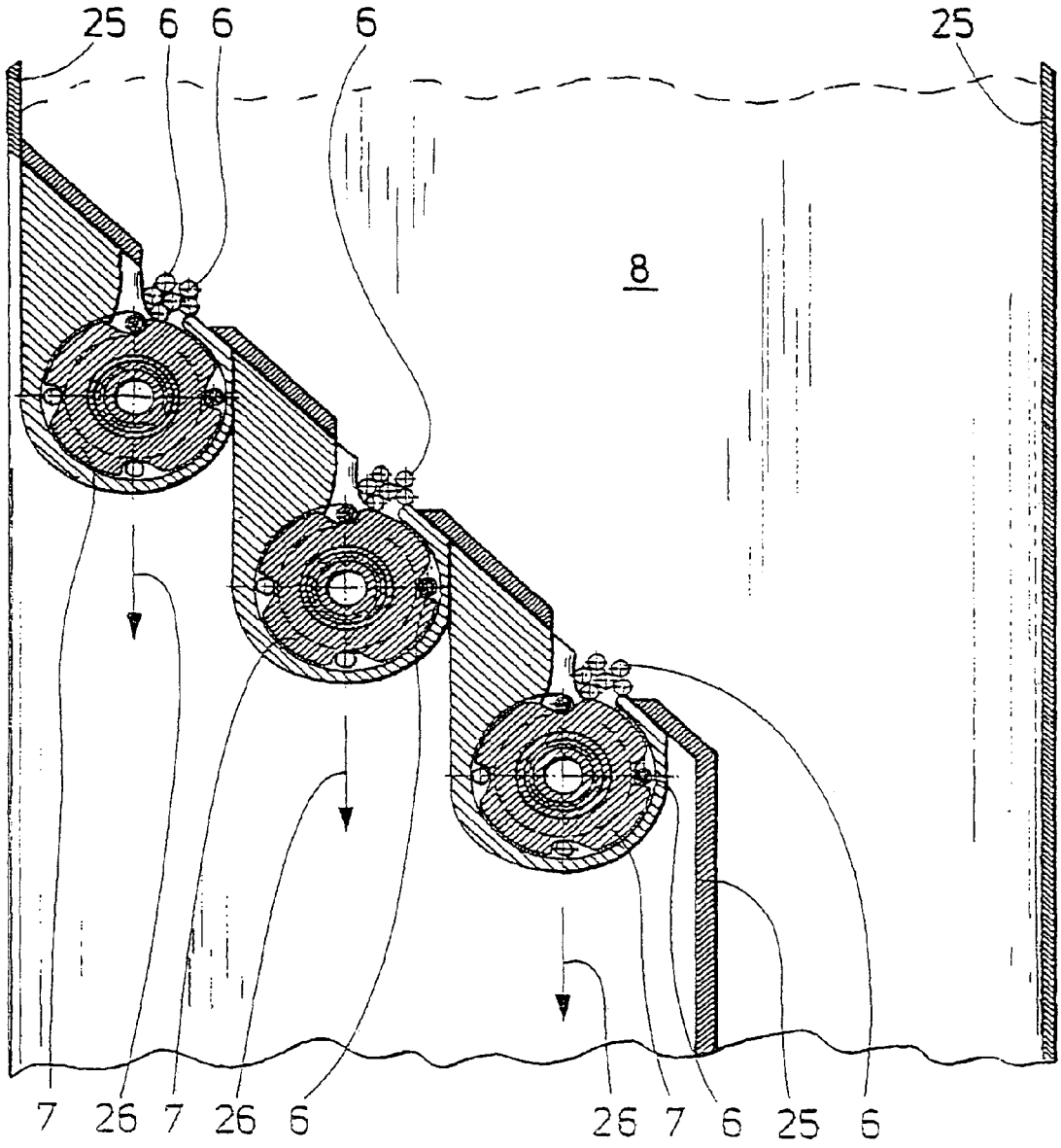
FIG. 6 shows one arrangement according to the invention in diagrammatic sectional view.

FIG. 6 shows a diagrammatic sectional view of an arrangement which utilizes many of the devices according to the invention. In this embodiment, three drum arrangements are utilized. Of course, this number can be two or even more than three without leaving the scope of the invention. The drum devices are arranged at an angle above one another. They also abut against the filter element magazine 8. The angle can be approximately 45 degrees, as is shown, or it can be any desired angle. The filter element magazine 8 in this embodiment is limited by magazine walls 25 as well as the drum devices according to the invention. Furthermore, the disposal device 26 for receiving the defective filter elements is also utilized. This is shown diagrammatically by arrows 26. It should be noted that any of the drum devices disclosed herein can be used in the arrangement shown in FIG. 6.

Figure 7:
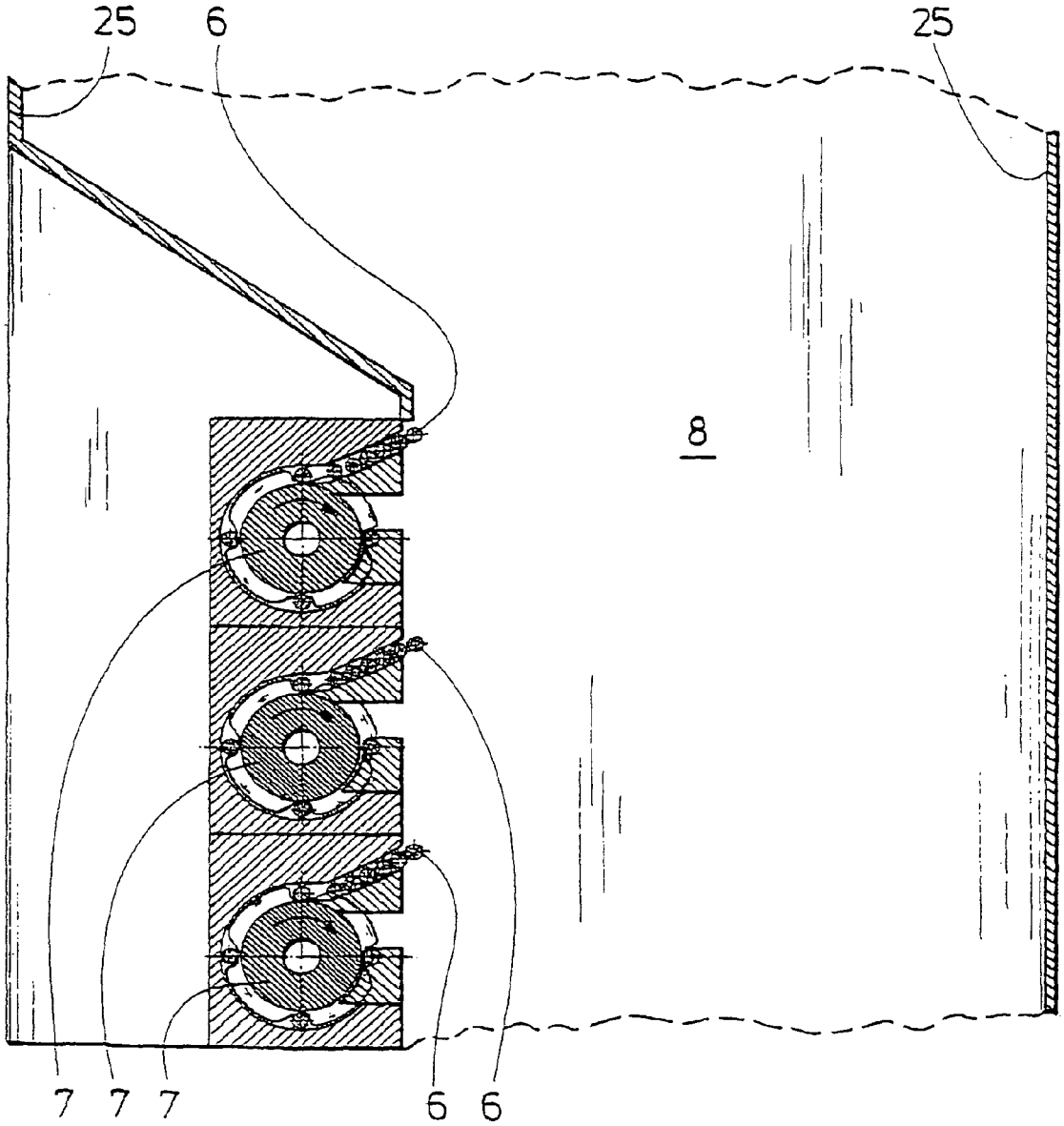
FIG. 7 shows another arrangement according to the invention in a diagrammatic sectional view.

FIG. 7 shows another arrangement according to the invention. In this arrangement, the drum devices are arranged vertically one above the other. It should be noted that any of the drum devices disclosed herein can be used in the arrangement shown in FIG. 7.

By providing a drum device with seat grooves for the filter elements, it is possible to provide for a form-locking generation of the insertion force of the filter elements into the filter element magazine. The generation of larger insertion forces is thus given.

With reference to FIG. 1, it can be noted that in order to feed filter elements to the drum 7, they are first accelerated in a lengthwise axial manner by way of the accelerating rollers 4. To this end, the drum 7 is in a rotation position in which the accelerated filter element 6 can arrive in the seat groove 19 of the drum 7.

In a preferred embodiment, the radial acceleration of the drum starts just when the filter element 6 leaves the light barrier. Subsequently, the drum 7 is braked (i.e., held stationary or prevented from rotating or stopped) in order to make the next seat groove available for the next filter element. Before the start of the rotation (in the case of the exemplary embodiment of FIG. 3), or after the start of the rotation (in the case of the exemplary embodiment of FIG. 4), the filter element is braked or retained in the seat groove. A movable and/or mechanical brake plate 20' (or 20 in the case of FIG. 3) is arranged on the circumference of the drum 7, in accordance with FIG. 4, and is used as a braking element. This braking element 20' can be a brake plate and is, in particular, adjustable and acts radially on the filter element to thereby brake the filter element more strongly as the angle of rotation increases.

The braking can also take place by way of a compressed air nozzle arranged on the face side such as is shown in, e.g., FIG. 2. This is operated, e.g., in a clocked manner, whereby the control can take place via a light barrier 10, 11.

In each of the embodiments, the filter element can be aligned in a crosswise axial manner between two stops through lengthwise axial sliding into the seat groove 19. The crosswise axial alignment can take place mechanically as well as pneumatically. In the exemplary embodiment according to FIG. 4, it is also possible that the alignment is carried out via the brake plate 20'. After a rotation of approximately 350°, the filter element 6 can be pressed out of the drum 7 through the interaction of the seat grooves side and a fork. The seat grooves 19, 19' should be embodied such that during the acceleration of the drum 7, the entire filter load of the magazine 8 does not press down on the drum bridge and the filter element 6 which is to be inserted into the magazine 8. For this reason, a relatively long extended side is provided in the seat groove 19, 19', which side holds the filter elements 6 in the filter element magazine 8 during the acceleration of the drum 7. When the filter element 6 is being pressed into the magazine 8, the drum 7 is in the braking phase. During braking, the counter-pressure helps the filter elements 6 located in the magazine 8.

To remove defective filter elements, the length of time that the filter element 6 spends in front of the light barrier is monitored via a light barrier 10, 11. In the event of a disturbance or detection of a defective filter 6, the light barrier 10, 11 is engaged longer than normal. In this case, the longitudinal transport stops immediately and a filter barrier of the type used in the prior art such as, e.g., the assignee's FILTROMAT 3 FE, becomes active. In this connection, reference is made, e.g., to U.S. Pat. No. 5,651,643, the disclosure of which is expressly incorporated by reference in its entirety. To remove the defective filter, the drum 7 is stopped at a specific position and, as described above, the filter 6 is removed from the drum 7. This can take place through mechanical elements or through compressed air. When necessary, the removal of the filter rods located in the longitudinal transport of the filter receiver can also take place either via the drum 7 or between the accelerating roller 4 and the drum 7. After a corresponding fault fixing, the device can be started up again. According to the invention, this can occur in a fully automatic manner.

Figure 8:
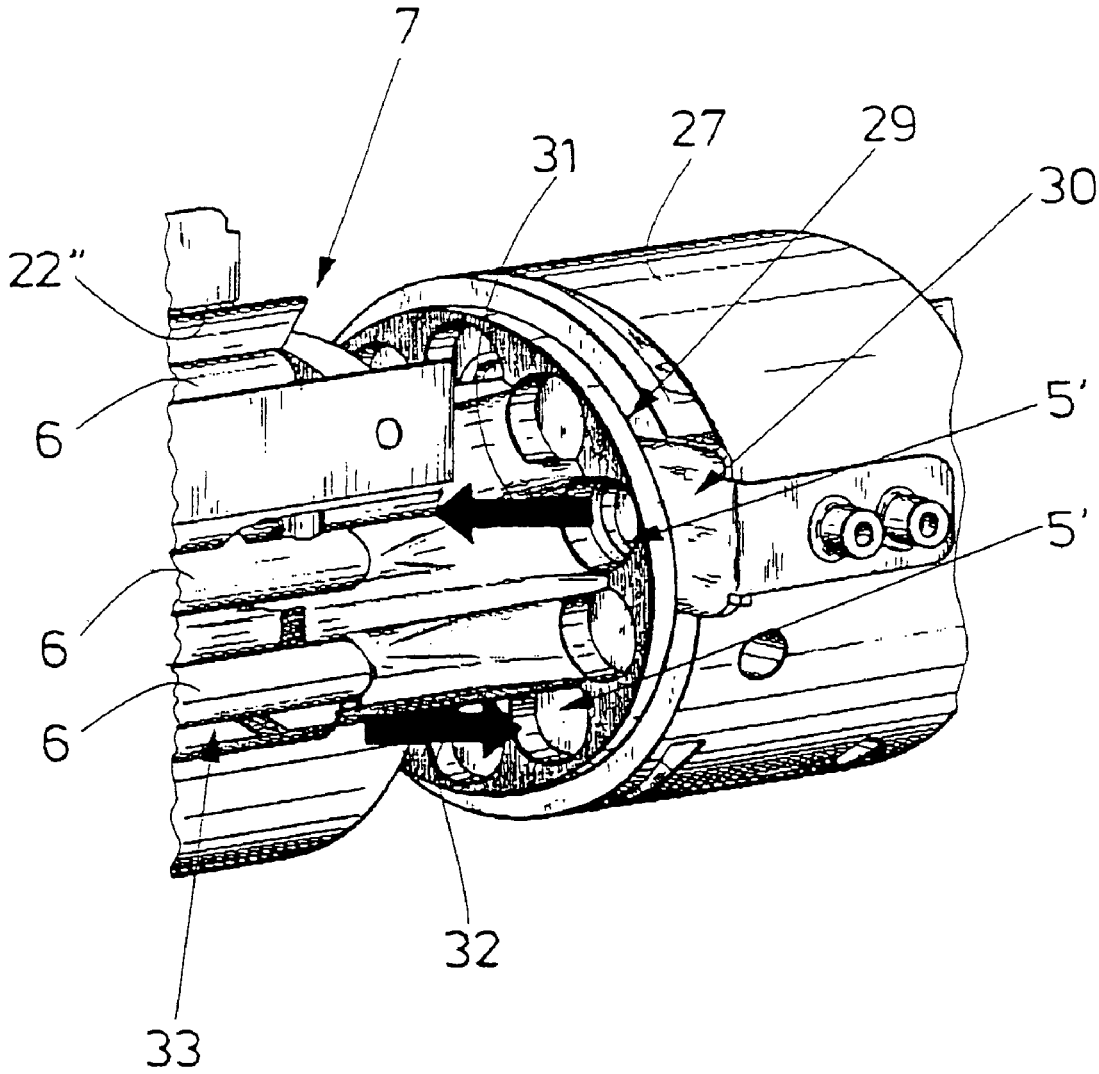
FIG. 8 shows a diagrammatic three-dimensional view of a section of another receiver station according to the invention.

FIG. 8 shows a partial diagrammatic three-dimensional view of another receiver station according to the invention. In this arrangement, a filter element 6 is fed through the mounting 27 and a ring-shaped opening in the moveable knife element 29. This occurs in the direction of the filter element feed 31. In this way, the filter element 6 is allowed to move to a seat 33 of the drum 7. If the element is a defective filter element, which can be detected by, e.g., by accounting for the dwell time in front of a light barrier 10, 11 (see FIG. 2) during the transport of the filter element 6 into the seat of the drum 7 (i.e., either because it is taking too long or because it is taking too short a time), the drum 7 is rotated. This rotation can be, e.g., two positions further, so that the filter element (or a part thereof) arranged in the seat can be blown out. This can occur in the filter element blowout position 32 by way of compressed air. In this way, it can be guided through the channel 5' until it reaches a waste container (not shown). This works, in particular, if the defective filter element has been completely inserted into the seat 33.

In a preferred embodiment of the invention, such as when the drum 7 starts to rotate before the filter element 6 has been completely inserted into the seat (or in the case where the filter elements are too long), a knife comprising a moveable knife element 29 and a fixed knife element 30 can be utilized to shear off or cut off the filter element accordingly. The part of the filter element 6 that has arrived in the seat can then be removed as described above. The part remaining in the feeding channel 5' can then be blown out of the channel 5' by opening a flap and acting upon it with compressed air in the direction opposite to the feed direction 31.

After a self-cleaning stage, it is preferred that the corresponding drum grooves or seats 33 be monitored by way of a light barrier to ascertain whether filter elements or parts of them still remain in the grooves or seats. This can be accomplished with a corresponding light barrier (not shown). This light barrier can, of course, be arranged at a suitable point in the seat. A corresponding light barrier can also be arranged at a suitable point in the channel 5'.

In FIG. 8, the cam 22" is also shown diagrammatically. Using this cam 22", the filter element 6 arranged at the top in FIG. 8 can be transferred to a filter element supply (not shown) in a targeted, defined and gentle manner.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 Connecting line
2 Side guide bearing
3 Brake roller
4 Accelerating roller
5, 5' Channel
6 Filter element
7 Drum
8 Magazine
9, 9' Collecting container
10 Light-emitting diode
11 Detector
12 Bearing
13 Rotational axis
14 Compressed air connection
15 Blowout direction
16 Blowout channel
17, 17' Rotational direction
18, 18', 18" Housing
19 Seat groove
20, 20' Braking element
21 Filter element feed
22, 22', 22" Cam
23 Flap
23' Flap in opened position
24 Rotational axis
25 Magazine wall
26 Disposal direction
27 Mounting
28 Channel
29 Moveable knife element
30 Fixed knife element
31 Filter element feed
32 Filter element blowout
33 Seat

What is claimed:

1. A device for conveying filter elements to a filter element magazine, the device comprising:

a guide bearing and a channel structured and arranged to convey the filter elements in a lengthwise axial direction, the lengthwise axial direction being defined as a direction along an axis of the filter element;

a rotatable drum comprising at least one seat for receiving a filter element conveyed to the drum via the guide bearing and the channel, the filter element being oriented in a lengthwise axial manner with respect to a conveying direction of the filter element; and a detection device that controls a rotation of the drum and detects when an end of the filter element has passed the detection device as the filter element is conveyed into the drum;

wherein the filter elements are fed by rotation of the drum to and inserted into the filter element magazine in a crosswise axial manner relative to the axis of each filter element.

2. The device of claim 1, wherein the filter elements comprise filter rods.

3. The device of claim 1, wherein the filter elements comprise rod-shaped filter elements.

4. The device of claim 1, wherein the detection device comprises a light barrier.

5. The device of claim 1, wherein the drum interacts with a mechanical element that causes a crosswise axial insertion of the filter elements into the filter element magazine.

6. The device of claim 1, further comprising a mechanism that causes a crosswise axial insertion of the filter elements into the filter element magazine.

7. The device of claim 1, wherein the at least one seat comprises a plurality of seats.

8. The device of claim 1, further comprising a braking element which engages the filter element.

9. The device of claim 8, wherein the braking element acts to provide braking to the filter element once the filter element is moved into the at least one seat.

10. The device of claim 8, wherein the braking element acts to provide braking to the filter element as the filter element is moved into the at least one seat.

11. The device of claim 1, further comprising a retaining mechanism which traps the filter element after the filter element is moved into the at least one seat.

12. The device of claim 11, wherein the retaining mechanism is movably mounted.

13. The device of claim 11, wherein the retaining mechanism can move away from the drum when the drum is rotated.

14. The device of claim 1, wherein the drum is adapted to rotate before the filter element has reached a final position in the at least one seat.

15. The device of claim 1, wherein the drum includes an element for aligning the filter elements.

16. The device of claim 1, further comprising a mechanism for aligning the filter elements on the drum.

17. The device of claim 1, further comprising an ejection mechanism adapted to eject defective filter elements.

18. A filter element receiver station comprising the device of claim 1.

19. An arrangement for conveying filter elements to a filter element magazine, comprising:

at least one device according to claim 1; and the filter element magazine, wherein the at least one device is arranged outside the filter element magazine.

20. The arrangement of claim 19, wherein the at least one device comprises a plurality of devices.

21. The arrangement of claim 20, wherein the plurality of devices comprises three devices.

22. The arrangement of claim 20, wherein the plurality of devices are arranged one below the other relative to a horizontal axis running through at least one of the plurality of devices.

23. The device of claim 1, wherein the at least one seat comprises a plurality of seat grooves.

24. The device of claim 23, further comprising an arrangement for removing the filter element or a portion of the filter element from one of the plurality of the seat grooves when the detection device determines that the filter element is found to be defective.

25. The device of claim 23, wherein the detection device is structured and arranged to detect when the filter element is entering into one of the plurality of seat grooves.

26. A device for conveying filter elements to a filter element magazine, the device comprising:

a rotatable drum comprising a plurality of seat grooves for receiving a filter element;

a detection device that controls a rotation of the drum and detects the filter elements by detecting when an end of a filter element has passed the detection device while being conveyed into one of the seat grooves; and a mechanism that feeds the filter elements in a lengthwise axial manner past the detection device and then to one of the plurality of seat grooves of the drum, the lengthwise axial manner being defined as a direction alone an axis of the filter element, wherein the filter elements are fed in a crosswise axial manner to the filter element magazine by rotating the drum.

27. The device of claim 26, further comprising an arrangement for removing the filter element or a portion of the filter element from one of the plurality of the seat grooves when the detection device determines that the filter element is found to be defective.

28. A device for conveying filter elements to a filter element magazine, the device comprising:

a rotatable drum comprising a plurality of seat grooves for receiving a filter element;

a detection device that controls a rotation of the drum and detects when the filter element is entering into one of the plurality of seat grooves by detecting when an end of a filter element has passed the detection device while being conveyed into one of the seat grooves;

a mechanism that feeds the filter elements in a lengthwise axial manner past the detection device and then to one of the plurality of seat grooves of the drum, the lengthwise axial manner being defined as a direction along an axis of the filter element, wherein the filter elements are fed to the filter element magazine by rotating the drum.

29. The device of claim 28, further comprising an arrangement for removing the filter element or a portion of the filter element from one of the plurality of the seat grooves when the detection device determines that the filter element is found to be defective.

* * * * *